US009748635B2

(12) United States Patent
Dabov

(10) Patent No.: US 9,748,635 B2
(45) Date of Patent: Aug. 29, 2017

(54) ELECTRONIC DEVICE WITH COMPONENT TRIM ANTENNA

(71) Applicant: Apple Inc., Cupertino, CA (US)

(72) Inventor: Teodor Dabov, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 364 days.

(21) Appl. No.: 14/340,983

(22) Filed: Jul. 25, 2014

(65) Prior Publication Data

US 2014/0333490 A1 Nov. 13, 2014

Related U.S. Application Data

(63) Continuation of application No. 13/396,499, filed on Feb. 14, 2012, now Pat. No. 8,803,745.

(51) Int. Cl.
*H01Q 7/00* (2006.01)
*H01Q 1/24* (2006.01)

(52) U.S. Cl.
CPC ..... *H01Q 1/243* (2013.01); *H01Q 7/00* (2013.01)

(58) Field of Classification Search
None
See application file for complete search history.

(56) References Cited

U.S. PATENT DOCUMENTS 4,733,245 A * 3/1988 Mussler ..... H01Q 19/09 343/769
5,768,217 A * 6/1998 Sonoda ..... G04B 47/025 343/718
5,945,956 A 8/1999 Izawa et al.
2005/0024278 A1 2/2005 Amemiya et al.
2008/0074329 A1 3/2008 Caballero et al.
2009/0278749 A1 11/2009 Jow
2010/0103612 A1 4/2010 Weber et al.
2010/0231470 A1 9/2010 Lee et al.
2010/0316368 A1* 12/2010 Young ..... G01S 19/14 396/310
2010/0321253 A1* 12/2010 Ayala Vazquez .... H01Q 1/2258 343/702
2011/0012796 A1 1/2011 Kim et al.
2011/0078749 A1 3/2011 Wieck
2012/0027056 A1 2/2012 Shinkai et al.

* cited by examiner

*Primary Examiner* — Dameon E Levi
*Assistant Examiner* — Andrea Lindgren Baltzell
(74) *Attorney, Agent, or Firm* — Treyz Law Group, P.C.; G. Victor Treyz; Michael H. Lyons

(57) ABSTRACT

An optical component such as a camera, an acoustic component such as a speaker, or other electrical component may be mounted on the surface of an electronic device housing. A window structure may overlap the component. The window structure may be formed form an optically transparent material to allow light to pass or may be formed from an acoustically transparent material to allow acoustic signals to pass. A conductive structure such as a metal member may surround at least part of the periphery of the window structure. The conductive structure may serve as an antenna structure for an antenna. Radio-frequency transceiver circuitry may be coupled to an antenna feed for the antenna using a radio-frequency transmission line. The conductive structure may serve as a cosmetic trim for the electrical component.

14 Claims, 12 Drawing Sheets

ELECTRONIC DEVICE WITH COMPONENT TRIM ANTENNA

This application is a continuation of U.S. patent application Ser. No. 13/396,499, filed Feb. 14, 2012, which is hereby incorporated by reference herein in its entirety. This application claims the benefit of and claims priority to U.S. patent application Ser. No. 13/396,499, filed Feb. 14, 2012.

BACKGROUND

This relates generally to electronic devices, and more particularly, to antennas for electronic devices.

Electronic devices such as portable computers and cellular telephones are often provided with wireless communications capabilities. For example, electronic devices may use long-range wireless communications circuitry such as cellular telephone circuitry to communicate using cellular telephone bands. Electronic devices may use short-range wireless communications circuitry such as wireless local area network communications circuitry to handle communications with nearby equipment. Electronic devices may also be provided with satellite navigation system receivers and other wireless circuitry.

To satisfy consumer demand for small form factor wireless devices, manufacturers are continually striving to implement wireless communications circuitry such as antenna components using compact structures. At the same time, it may be desirable to include conductive structures in an electronic device such as metal device housing structures and electronic components. Because conductive structures can affect radio-frequency performance, care must be taken when incorporating antennas into an electronic device that includes conductive structures. If antennas are not mounted properly within a device, antenna performance may suffer.

It would therefore be desirable to be able to provide improved antenna mounting arrangements for wireless electronic devices.

SUMMARY

An electronic device may have a housing. An optical component such as a camera, an acoustic component such as a speaker, or other electrical component may be mounted on a surface of the housing. A window structure may overlap the component. The window structure may be formed form an optically transparent material to allow light to pass or may be formed from an acoustically transparent material to allow acoustic signals to pass. The window structure may be mounted flush with the surface of the housing or may be mounted to a protruding portion of the housing.

A conductive structure such as a metal member may surround at least part of the periphery of the window structure. The conductive structure may serve as a cosmetic trim for the electrical component. The conductive structure may serve as an antenna structure for an antenna. Radio-frequency transceiver circuitry may be coupled to an antenna feed for the antenna using a radio-frequency transmission line.

Further features of the invention, its nature and various advantages will be more apparent from the accompanying drawings and the following detailed description of the preferred embodiments.

DETAILED DESCRIPTION

Figure 1:
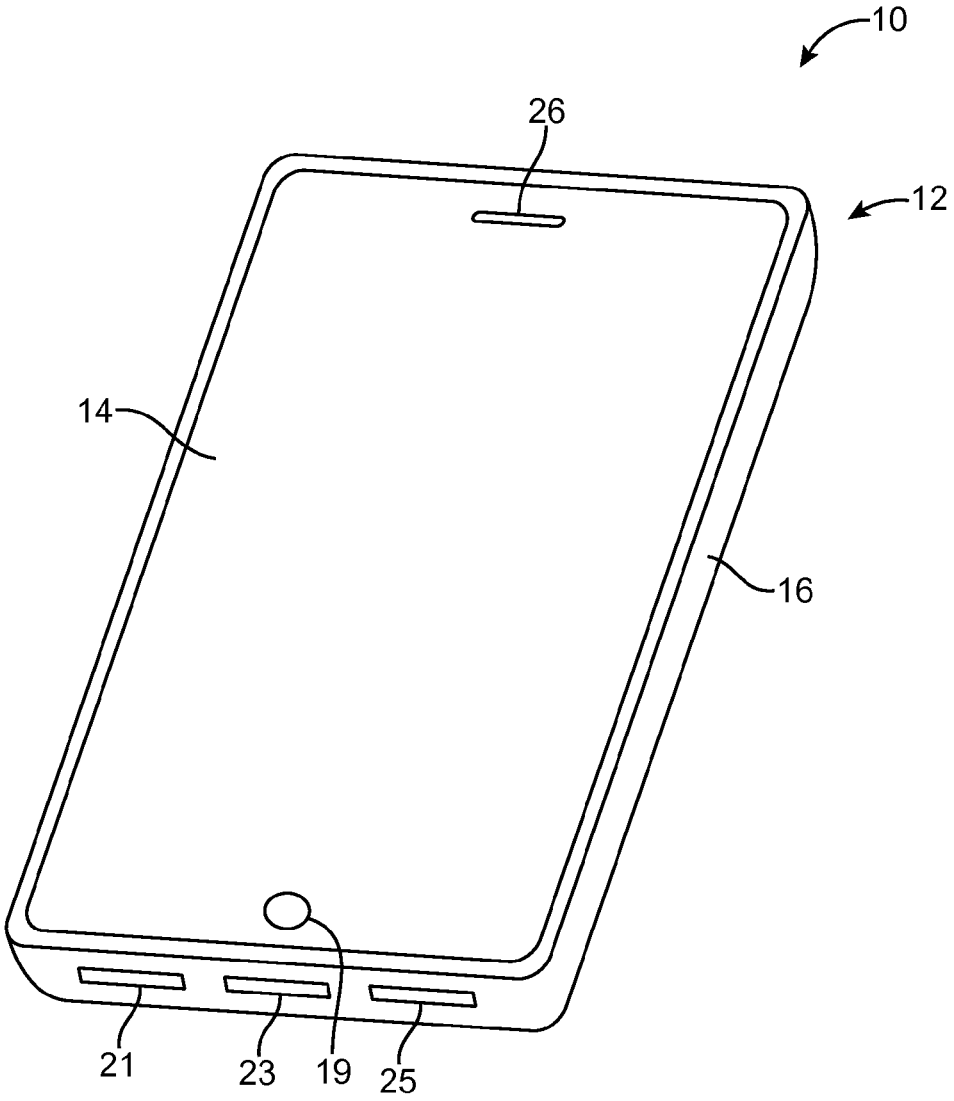
FIG. 1 is a front perspective view of an illustrative electronic device with wireless communications circuitry in accordance with an embodiment of the present invention.

Electronic devices such as electronic device 10 of FIG. 1 may be provided with one or more antennas. The antennas can include loop antennas, inverted-F antennas, strip antennas, planar inverted-F antennas, slot antennas, hybrid antennas that include antenna structures of more than one type, or other suitable antennas. Conductive structures for the antennas may, if desired, be formed from conductive electronic device structures such as housing structures, component structures, or other conductive structures. Examples in which electronic device 10 is provided with an antenna that is formed from a trim structure or other structure that is associated with an electrical component and the structures with which the electronic component is mounted in electronic device 10 are sometimes described herein as an example.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a cellular telephone, or a media player. Device 10 may also be a television, a set-top box, a desktop computer, a computer monitor into which a computer has been integrated, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

Device 10 may, if desired, have a display such as display 14. Display 14 may, for example, be a touch screen that incorporates capacitive touch electrodes. Display 14 may include image pixels formed form light-emitting diodes (LEDs), organic LEDs (OLEDs), plasma cells, electrowetting pixels, electrophoretic pixels, liquid crystal display (LCD) components, or other suitable image pixel structures. A cover glass layer may cover the surface of display 14. Buttons such as button 19 may pass through openings in the cover glass. The cover glass may also have other openings such as an opening for speaker port 26.

Housing 12 may include a peripheral member such as member 16. Member 16 may run around the periphery of device 10 and display 14. In configurations in which device 10 and display 14 have a rectangular shape, member 16 may have a rectangular ring shape (as an example). Member 16 or part of member 16 may serve as a bezel for display 14 (e.g., a cosmetic trim that surrounds all four sides of display 14 and/or helps hold display 14 to device 10). Member 16 may also, if desired, form sidewall structures for device 10 (e.g., by forming a metal band with vertical sidewalls, etc.). Member 16 may be formed of a conductive material and may therefore sometimes be referred to as a peripheral conductive member or conductive housing structure. Member 16 may be formed from a metal such as stainless steel, aluminum, or other suitable materials. One, two, three, or more than three separate structures may be used in forming member 16 (e.g., member 16 may be separated into segments by dielectric-filled gaps).

Housing 12 (e.g., peripheral member 16 or other housing structures) may have openings such as openings 21, 23, and 25. Openings such as opening 23 may be used to form input-output ports (e.g., ports that receive analog and/or digital connectors such as Universal Serial Bus connectors, 30-pin data connectors, data connectors with 5-10 contacts, audio jack connectors, video connectors, or other connectors). Openings such as openings 21 and 25 may be used to accommodate electrical components such as audio components or other electrical devices. Opening 21 may, for example, form a microphone port and opening 25 may form a speaker port. Other portions of housing 12 such as other sidewall portions or other portions of the front or rear planar surface of device 12 may also be provided with structures to accommodate components.

Components may, for example, be associated with housing openings (e.g., ports), connectors, dielectric structures that are part of housing 12 or that are mounted to housing 12, optical and/or radio-frequency-transparent window structures (e.g., glass, plastic, or other dielectric materials that are flush with housing 12, glass, plastic, or other dielectric materials that are mounted using conductive and/or dielectric structures that protrude from housing 12), acoustically transparent window structures, or other device structures. Components may be mounted on sidewalls formed from peripheral member 16 or sidewalls that are part of a planar front or rear portion of housing 12 or may be mounted on front or rear planar surfaces of housing 12.

Housing 12 may have a planar front surface (e.g., a front surface such as the surface of a planar cover layer over display 14 of FIG. 1). As shown in the rear perspective view of device 10 of FIG. 2, housing 12 may have an opposing rear surface such as a planar surface associated with opposing rear housing structure 58. Rear housing structure 58, which may sometimes be referred to as a rear housing member, rear housing wall, or planar housing member) may be formed from glass, ceramic, plastic, metal, carbon-fiber composites or other fiber-based composites, other materials, or a combination of two or more of any of these materials.

Figure 2:
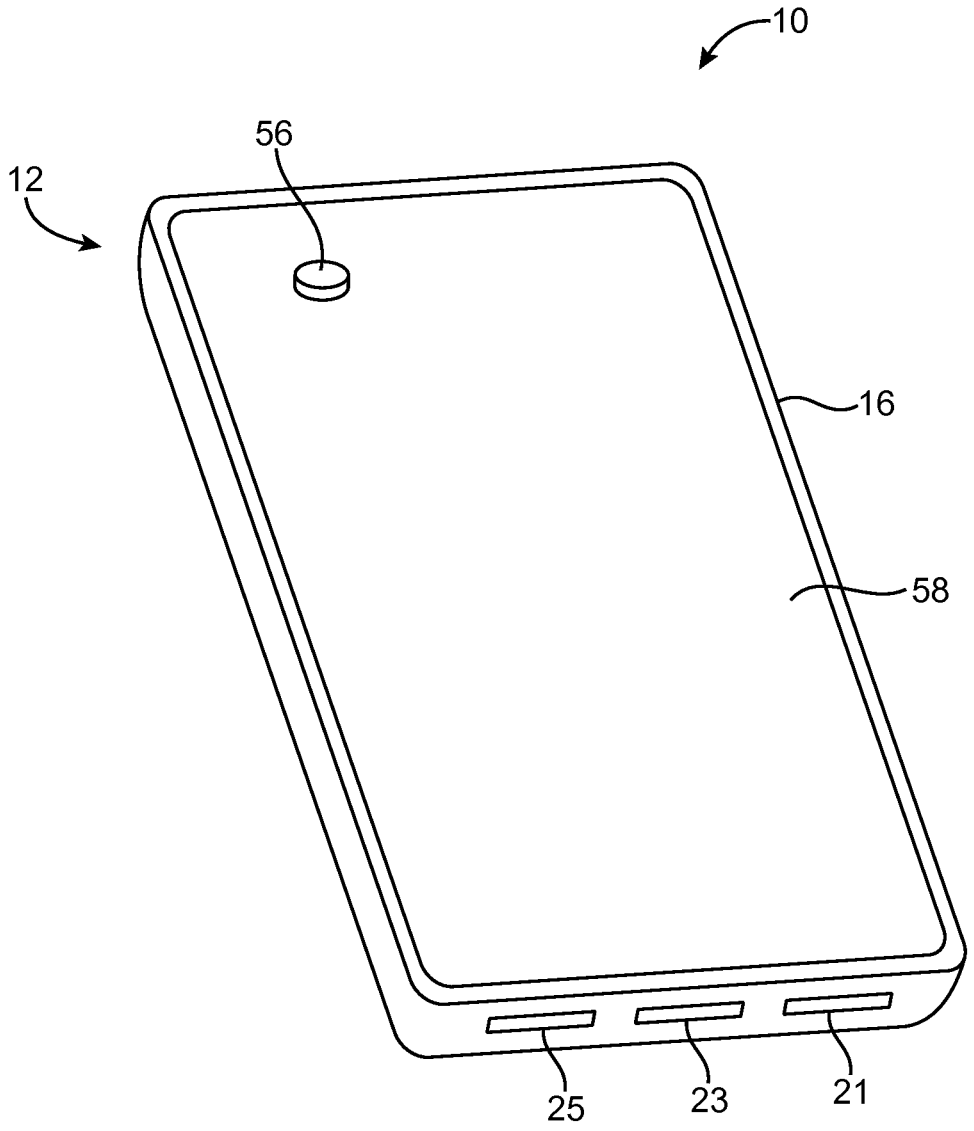
FIG. 2 is a rear perspective view of an electronic device showing how an electronic component may have a structure that protrudes from the housing of the electronic device in accordance with an embodiment of the present invention.

Device 10 may be provided with structures such as structure 56 that are associated with a camera, sensor, or other optical component, a microphone, a speaker, or other audio component (e.g., an audio component in an acoustic port such as ports 21 and 24 of FIG. 1), or other electrical component in device 10. Structure 56 may have an optically transparent window to allow light to reach a camera image sensor or to exit or enter other light-based components, an acoustically transparent window such as an acoustic mesh structure to allow sound to reach a microphone or to exit a speaker or to otherwise accommodate an audio device, or may have other structures associated with the housing and use of an electrical component. In the example of FIG. 2, structure 56 has been formed in the upper left portion of the rear of housing 12. This is merely illustrative. Structures such as structure 56 may be formed elsewhere on the rear housing structure 56, on the front of housing 12, on a sidewall of housing 12, or two or more of these surfaces of device 10, etc.

Structure 56 may lie flush with the surface of device 10 or may protrude from the surface of device 10. For example, structure 56 may lie flush with portions of housing 12 such as rear housing structure 58 or may have portions that protrude from the surface of rear housing structure 58 or other portions of housing 12.

One or more antennas for device 10 may be formed from conductive structures that are associated with structure 56. For example, structure 56 may have a window structure such as a transparent optical window or an acoustically transparent window formed from a mesh or other structure with acoustic openings. The window structure may be provided with one or more conductive structures such as one or more strips of metal. Metals strips such as strips of stainless steel, aluminum, plated copper, or other materials may be used in enhancing the aesthetics of structure 56 (e.g., by serving as cosmetic trim structures), may be used in blocking stray light or otherwise performing optical functions, may be used in blocking or reflecting sound (e.g., when used in an audio component such as a speaker or microphone), may be used in providing structural support for structure 56, or may be used to provide other functions or two or more of these functions. By coupling an antenna feed to these conductive structures so that the conductive structures can serve as an antenna for device 10, the conductive structures can also be used in transmitting and receiving radio-frequency signals. Antennas may also include parts of housing 12 such as peripheral conductive member 16, conductive traces on printed circuit board, and other conductive structures.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, 60 GHz communications (e.g., IEEE 802.11ad communications), etc.

Figure 3:
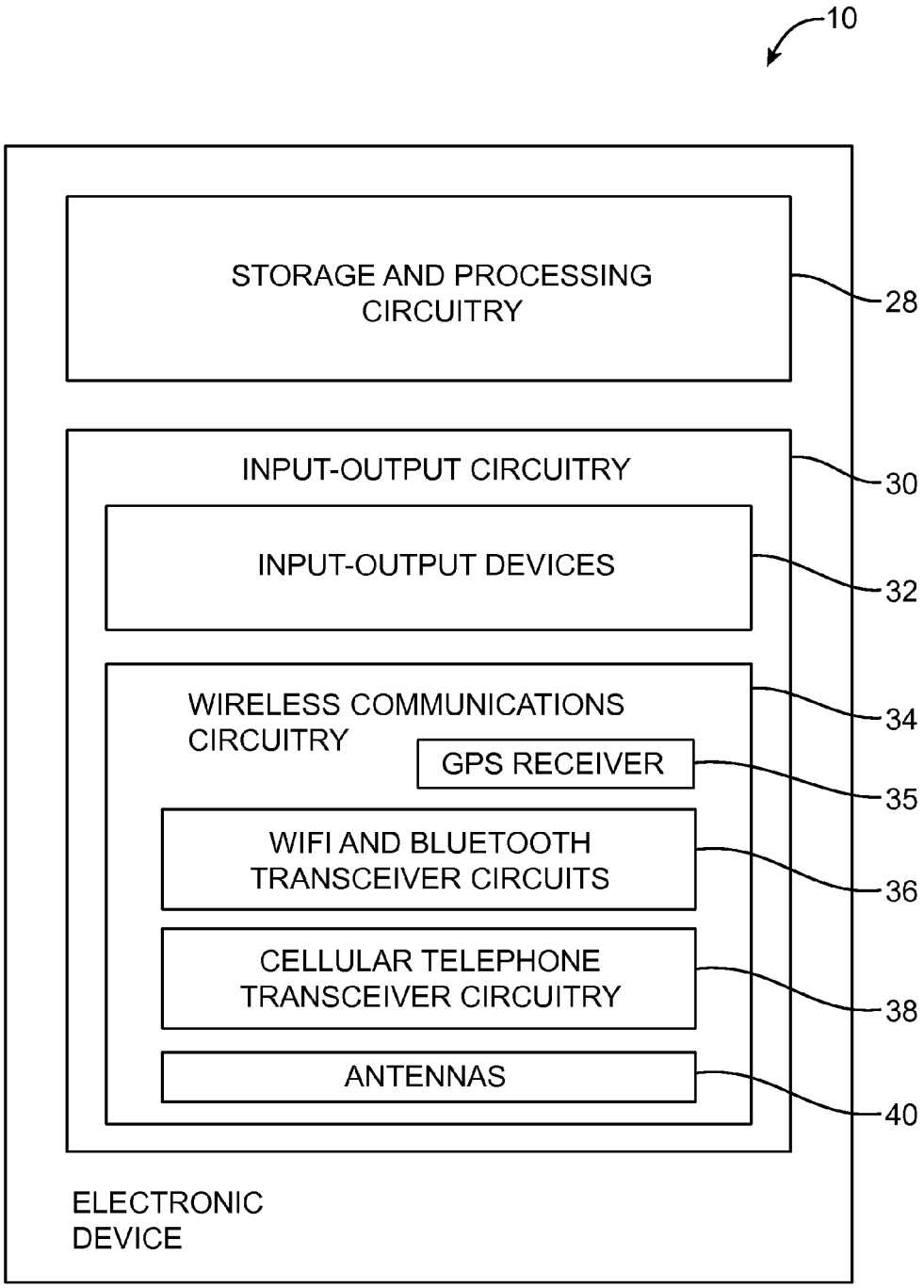
FIG. 3 is a schematic diagram of an illustrative electronic device of the type shown in FIGS. 1 and 2 in accordance with an embodiment of the present invention.

A schematic diagram of an illustrative configuration that may be used for electronic device 10 is shown in FIG. 3. As shown in FIG. 3, electronic device 10 may include storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. The processing circuitry may be based on one or more microprocessors, microcontrollers, digital signal processors, baseband processors, power management units, audio codec chips, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, etc.

Circuitry 28 may be configured to implement control algorithms that control the use of antennas in device 10. For example, circuitry 28 may perform signal quality monitoring operations, sensor monitoring operations, and other data gathering operations and may, in response to the gathered data and/or information on which communications bands are to be used in device 10, control which antenna structures within device 10 are being used to receive and process data and/or may adjust one or more switches, tunable elements, or other adjustable circuits in device 10 to adjust antenna performance.

Input-output circuitry 30 may be used to allow data to be supplied to device 10 and to allow data to be provided from device 10 to external devices. Input-output circuitry 30 may include input-output devices 32. Input-output devices 32 may include touch screens, buttons, joysticks, click wheels, scrolling wheels, touch pads, key pads, keyboards, microphones, speakers, tone generators, vibrators, cameras, sensors (e.g., ambient light sensors, light-based proximity sensors, etc.), light-emitting diodes and other status indicators, data ports, etc. A user can control the operation of device 10 by supplying commands through input-output devices 32 and may receive status information and other output from device 10 using the output resources of input-output devices 32.

Wireless communications circuitry 34 may include radio-frequency (RF) transceiver circuitry formed from one or more integrated circuits, power amplifier circuitry, low-noise input amplifiers, passive RF components, one or more antennas, and other circuitry for handling RF wireless signals. Wireless signals can also be sent using light (e.g., using infrared communications).

Wireless communications circuitry 34 may include satellite navigation system receiver circuitry such as Global Positioning System (GPS) receiver circuitry 35 (e.g., for receiving satellite positioning signals at 1575 MHz) or satellite navigation system receiver circuitry associated with other satellite navigation systems. Transceiver circuitry 36 may handle 2.4 GHz and 5 GHz bands for WiFi® (IEEE 802.11) communications, may handle the 2.4 GHz Bluetooth® communications band, and may handle other wireless local area network communications bands of interest (e.g., 60 GHz signals associated with IEEE 802.11ad communications). Circuitry 34 may use cellular telephone transceiver circuitry 38 for handling wireless communications in cellular telephone bands such as bands in frequency ranges of about 700 MHz to about 2700 MHz or bands at higher or lower frequencies. Wireless communications circuitry 34 can include circuitry for other short-range and long-range wireless links if desired. For example, wireless communications circuitry 34 may include global positioning system (GPS) receiver equipment or other satellite navigation system equipment, wireless circuitry for receiving radio and television signals, paging circuits, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include one or more antennas 40. Antennas 40 may be formed using any suitable antenna types. For example, antennas 40 may include antennas with resonating elements that are formed from loop antenna structure, patch antenna structures, inverted-F antenna structures, closed and open slot antenna structures, planar inverted-F antenna structures, helical antenna structures, strip antennas, monopoles, dipoles, hybrids of these designs, etc. Different types of antennas may be used for different bands and combinations of bands. For example, one type of antenna may be used in forming a local wireless link antenna and another type of antenna may be used in forming a remote wireless link.

Figure 4:
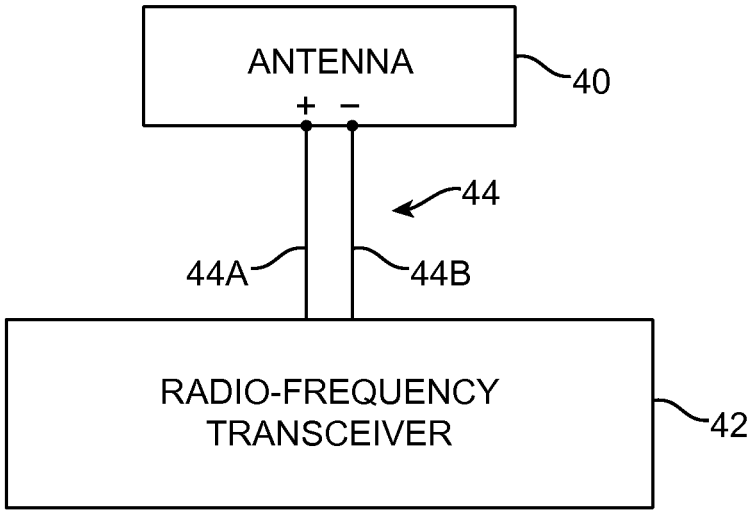
FIG. 4 is diagram of an illustrative antenna coupled to radio-frequency transceiver circuitry by a communications path in accordance with an embodiment of the present invention.

FIG. 4 is a diagram showing how radio-frequency signal path 44 may be used to convey radio-frequency signals between antenna 40 and radio-frequency transceiver 42. Antenna 40 may be one of antennas 40 of FIG. 3. Radio-frequency transceiver 42 may be a receiver and/or transmitter in wireless communications circuitry 34 (FIG. 3) such as receiver 35, wireless local area network transceiver 36 (e.g., a transceiver operating at 2.4 GHz, 5 GHz, 60 GHz, or other suitable frequency), cellular telephone transceiver 38, or other radio-frequency transceiver circuitry for receiving and/or transmitting radio-frequency signals.

Signal path 44 may include one or more transmission lines such as one or more segments of coaxial cable, one or more segments of microstrip transmission line, one or more segments of stripline transmission line, or other transmission line structures. Signal path 44 may include a positive conductor such as positive signal line 44A and may include a ground conductor such as ground signal line 44B. Antenna 40 may have an antenna feed with a positive antenna feed terminal (+) and a ground antenna feed terminal (−). If desired, circuitry such as filters, impedance matching circuits, switches, amplifiers, and other circuits may be interposed within path 44.

Figure 5:
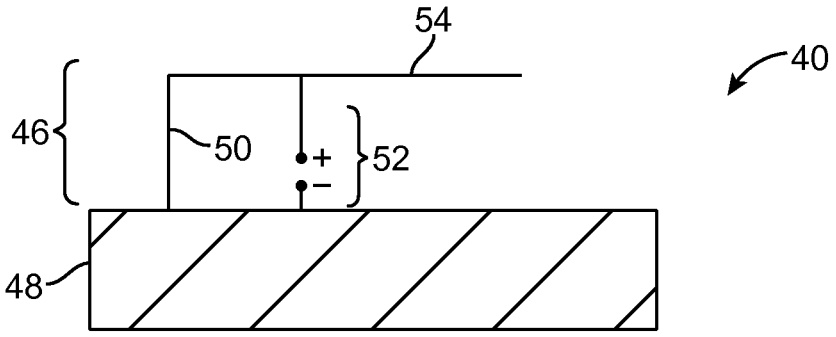
FIG. 5 is a diagram of an illustrative inverted-F antenna structure of the type that may be used in an electronic device in accordance with an embodiment of the present invention.

FIG. 5 is a diagram showing how antenna 40 may be implemented using an inverted-F configuration. As shown in FIG. 5, antenna 40 may include an antenna ground such as antenna ground 48 and may include an inverted-F antenna resonating element such as antenna resonating element 46. Antenna resonating element 46 may have a main resonating element arm such as arm 54. Short circuit branch 50 may be coupled between arm 54 and ground 48. Antenna feed arm 52 may also be coupled between arm 54 and ground 48 and may include an antenna feed with positive and ground antenna feed terminals (e.g., an antenna feed coupled to a signal path such as path 44 of FIG. 4).

Figure 6:
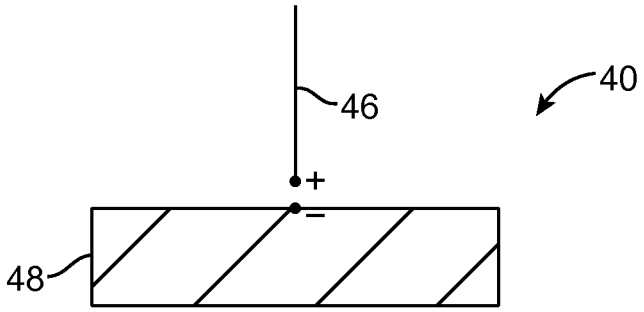
FIG. 6 is a diagram of an illustrative monopole antenna structure of the type that may be used in an electronic device in accordance with an embodiment of the present invention.

FIG. 6 is a diagram showing how antenna 40 may be implemented using a monopole antenna configuration. As shown in FIG. 6, antenna 40 may include an antenna ground such as antenna ground 48 and may include a monopole antenna resonating element such as antenna resonating element 46. Antenna resonating element 46 and ground 48 may be feed using an antenna feed that includes a positive antenna feed terminal (+) that is coupled to antenna resonating element 46 and a ground antenna feed terminal (−) that is coupled to antenna ground 48.

Figure 7:
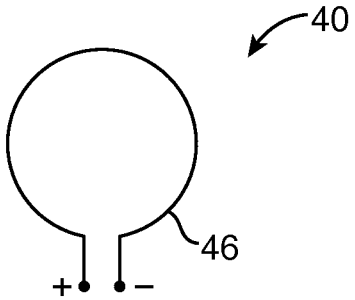
FIG. 7 is a diagram of an illustrative loop antenna structure of the type that may be used in an electronic device in accordance with an embodiment of the present invention.

In the example of FIG. 7, antenna 40 has been implemented using a loop antenna configuration. In this type of arrangement, antenna resonating element 46 has been configured to form a loop that is fed by an antenna feed having a positive antenna feed terminal (+) and a ground antenna feed terminal (−) that are each coupled to different portions of the antenna resonating element.

The illustrative antenna configurations of FIGS. 5, 6, and 7 are merely illustrative. In general, antenna 40 may be implemented using any suitable type of antenna (e.g., loop antenna structures, patch antenna structures, inverted-F antenna structures, closed and open slot antenna structures, planar inverted-F antenna structures, helical antenna structures, strip antennas, monopoles, dipoles, hybrids of these designs, etc.).

The conductive structures that form antenna 40 may be formed from strips of metal or other metal structures, conductive housing structures (e.g., metal structures such as stainless steel structures, aluminum structures, or structures formed from other metals), portions of conductive components (e.g., parts of switches, connectors, etc.), conductive traces on a printed circuit (e.g., metal traces on a flexible printed circuit that is formed from a flexible sheet of polyimide or other polymers or a rigid printed circuit board substrate such as an FR4 substrate), conductive structures such as metal traces formed on a structure formed from glass, ceramic, plastic, other dielectric materials, or a combination of two or more of these materials, or other conductors.

If desired, at least some of the conductive structures for antenna 40 may be associated with structure 56 (FIG. 2). For example, at least some of the conductive structures for antenna 40 such as antenna resonating element 46 and/or antenna ground 48 may be formed from part or all of a cosmetic trim structure for structure 56 or conductive structures that are otherwise associated with structure 56 (e.g., conductive structures within a camera or in the vicinity of a camera that is associated with structure 56, conductive structures within a speaker or in the vicinity of a speaker that is associated with structure 56, or other structures that are mounted on or near structure 56). The conductive structures may, for example, surround some or all of the periphery of an optical or acoustic window structure that is mounted in structure 56 overlapping the camera, speaker, or other electrical component.

Figure 8:
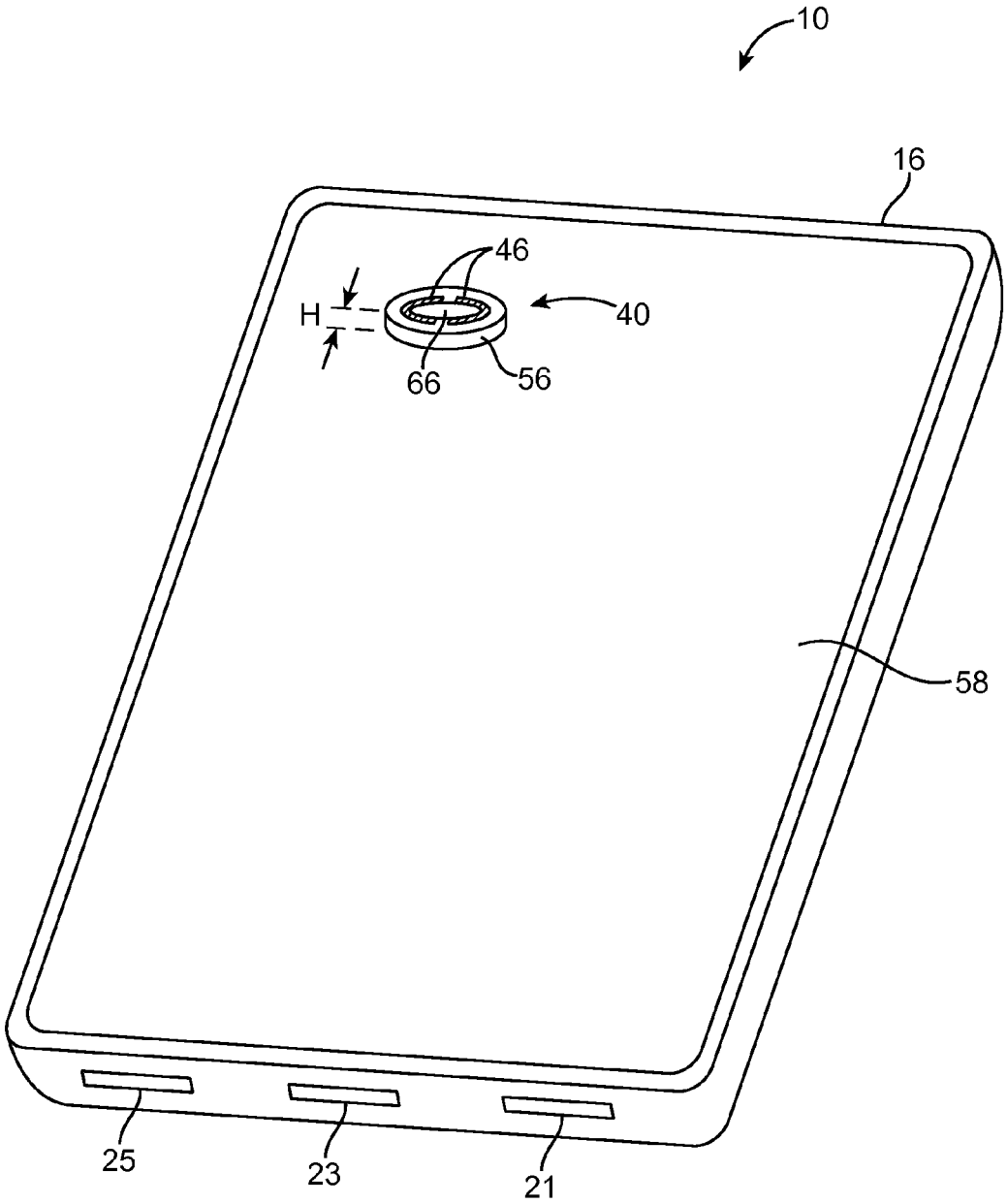
FIG. 8 is a rear perspective view of an electronic device having an electronic component that has a trim structure that serves as an antenna structure in accordance with an embodiment of the present invention.

FIG. 8 is a perspective view of an illustrative configuration for device 10 in which conductive antenna structures for antenna 40 such as antenna resonating element 46 have been formed on structure 56. Structure 56 may be associated with a component such as a camera, a speaker, or other component in device 10. Structure 56 may protrude above the surface of rear housing wall 58. As shown in FIG. 8, for example, structure 56 may protrude a distance H above the surface of rear housing wall 58 so that the surface of electronic component window structure 66 lies a distance H above the surface of rear housing wall 58. Electronic component window structure 66 may have a circular shape, a rectangular shape, or other outline and may be mounted to structure 56. Antenna resonating element 46 may surround some or all of the periphery of window structure 66.

Figure 9:
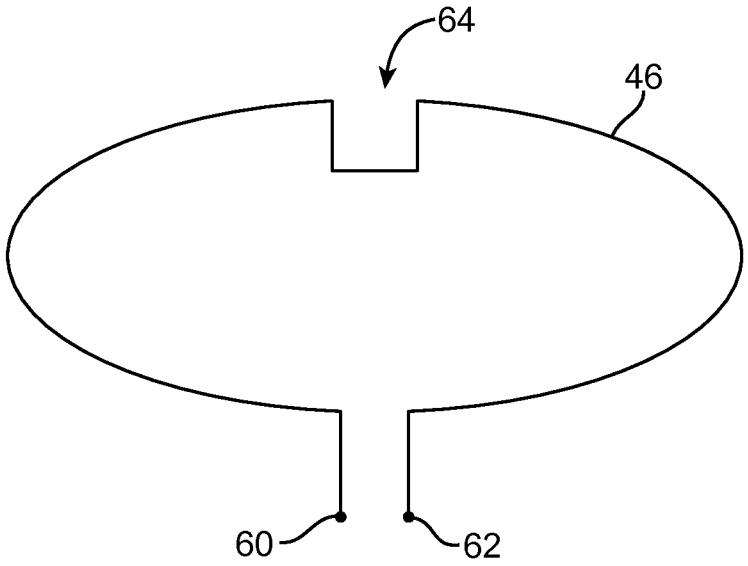
FIG. 9 is a perspective view of an illustrative antenna structure of the type shown in FIG. 8 that may be used in an electronic device in accordance with an embodiment of the present invention.

As shown in the example of FIG. 9, antenna resonating element structure 46 of FIG. 8 may have a circular shape with terminals 60 and 62. Terminals 60 and 62 may, for example, form an antenna feed for antenna 40 in a configuration in which antenna resonating element structure 46 is used as a loop antenna. If desired, antenna resonating element structure 46 of FIG. 9 may be used to form other types of antenna structures such as inverted-F antenna resonating antenna 40 of FIG. 5, monopole antenna 40 of FIG. 7, etc. Terminal 60 and/or terminal 62, and/or other portions of antenna resonating element 46 may be used in forming an antenna feed terminal for antenna 40. Antenna resonating element structure 46 of FIG. 9 includes optional notch 64. Notch 64 may be included in antenna resonating element 46 so that the exposed portion of antenna resonating element 46 forms two C-shaped segments running along opposing portions of the periphery of window structure 66, as shown in FIG. 8. If desired, antenna resonating element 46 may be provided with two or more notches such as notch 64 or notch 64 may be omitted.

Figure 10:
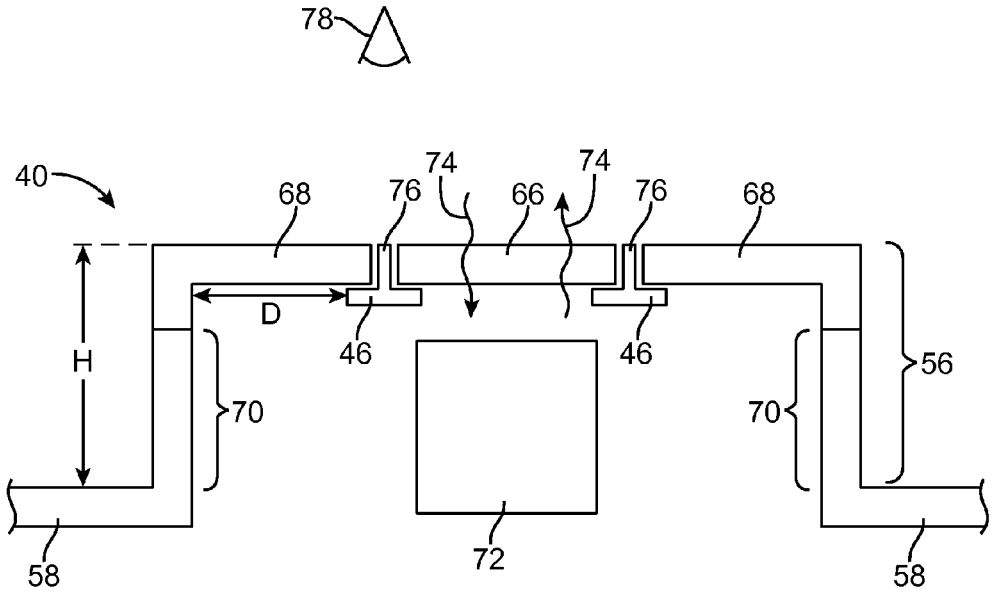
FIG. 10 is a cross-sectional side view of an electronic component that has been mounted in an electronic device housing and that has a conductive trim structure that serves as an antenna structure in accordance with an embodiment of the present invention.

FIG. 10 is a cross-sectional side view of structure 56 in a configuration in which part of structure 56 has been formed from rear housing structure (housing wall) 58. Structure 56 may be associated with component 72. Component 72 may be an optical component such as a light sensor, status indicator light, camera, or other electronic device that uses light or may be an audio component such as a speaker that produces sound, a microphone that receives sound, or other component that uses sound. If desired, component 72 may be implemented using other electronic devices. The use of optical and audio devices as component 72 is merely illustrative.

As shown in FIG. 10, structure 56 may include a window structure such as window 66 that overlaps component 72. Window 66 may include structures that are transparent to light and/or sound and that allow signals 74 to enter and/or exit device 10. Signals 74 may be optical signals (light) and/or acoustic signals. For example, component 72 may be a camera, light sensor, light source, or other optical component that produces and/or receives light 74 through transparent optical window 66. As another example, component 72 may be a microphone, speaker, buzzer, or other sound source or sound detector that can transmit and/or receive sound 74 through acoustically transparent window 66. An acoustically transparent structure for window 66 may, for example, be formed from a mesh structure (e.g., a plastic mesh) or a structure with circular holes, rectangular holes, or other openings that allow sound to pass.

Structure 56 may include portions of housing member 58 such as vertically extending portions 70. One or more additional structures such as structures 68 may also be used in forming structure 56. Antenna resonating element 46 may be mounted in structure 56 around the periphery of window structure 66 and may be used in transmitting and/or receiving radio-frequency signals for device 10.

In configurations of the type shown in FIG. 10 in which structure 56 protrudes a distance H from the surface of rear housing wall 58 or other housing structures in device 10, antenna resonating element 46 (i.e., antenna 40) may protrude from the surface of device 10, thereby reducing signal blockage and helping to enhance antenna performance. Antenna performance may also be enhanced by ensuring that there is sufficient separation between antenna resonating element 46 and adjacent conductive structures. For example, in configurations in which structure 58 is formed from a conductive material such as metal, antenna performance may be enhanced by forming structure 68 from a dielectric such as plastic to ensure that antenna resonating element 46 and portion 70 of structure 58 are separated by a minimum distance D (e.g., a distance D of at least 0.5 mm, of at least 1.0 mm, of at least 2.0 mm, or at least 5 mm (as examples). If desired, portions 70 of structures 58 may be formed from dielectric or other portions of structures 58 or all of structures 58 may be formed from dielectric.

In a configuration of the type shown in FIG. 10, window 66 may be transparent to light and/or sound, so that component 72 can use light and/or sound that is passing through window 66. Structures 68 may, if desired, be opaque to sound and/or light. For example, structures 68, portion 70 of structures 58, and other portions of structure 58 and housing 12 may be formed from opaque plastic, from metal, from layers of one or more materials that include at least one opaque layer, or other structures that are not optically and/or acoustically transparent.

Antenna resonating element 46 may have portions such as portion 76 that are visible to viewer 78 (e.g., a user of device 10) from the exterior of device 10. Antenna resonating element 46 may therefore serve as a cosmetic trim for structure 56 and component 72. Antenna resonating element 46 may, as an example, be formed from a stainless steel member, a plated copper structure, or other metal structure that surrounds some or all of window 66 to provide a cosmetic outline for window 66, while simultaneously being used as part of antenna 40 for handling radio-frequency signals for device 10.

Figure 11:
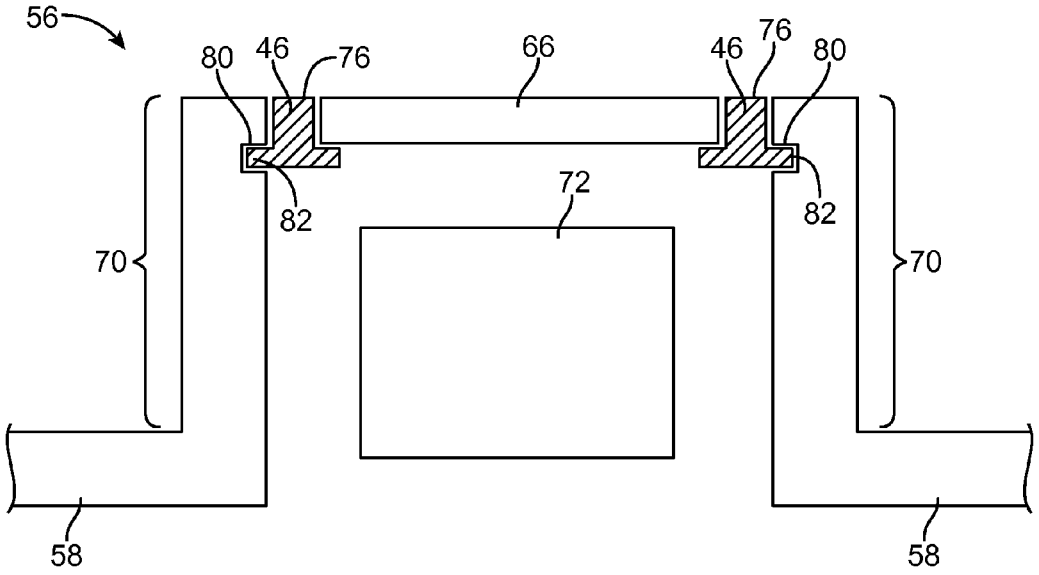
FIG. 11 is a cross-sectional side view of an electronic component trim structure that may be used as an antenna structure and that may be mounted to a dielectric housing structure that protrudes from an electronic device in accordance with an embodiment of the present invention.

FIG. 11 is a cross-sectional side view of structure 56 in a configuration in which the sidewalls of structure 56 have been formed from portion 70 of structure 58 (e.g., plastic portions or portions of glass, ceramic, or other structures). Grooves such as grooves 80 or other engagement features may be formed in portions 70 to receive corresponding portions 82 of antenna resonating element 46. Antenna resonating element 46 of FIG. 11 may be formed from a metal member other structure. Exposed portion 76 of antenna resonating element 46 may be visible to a user of device 10 so that antenna resonating element 46 may serve as cosmetic trim for window 66, structure 56, and component 72.

Figure 12:
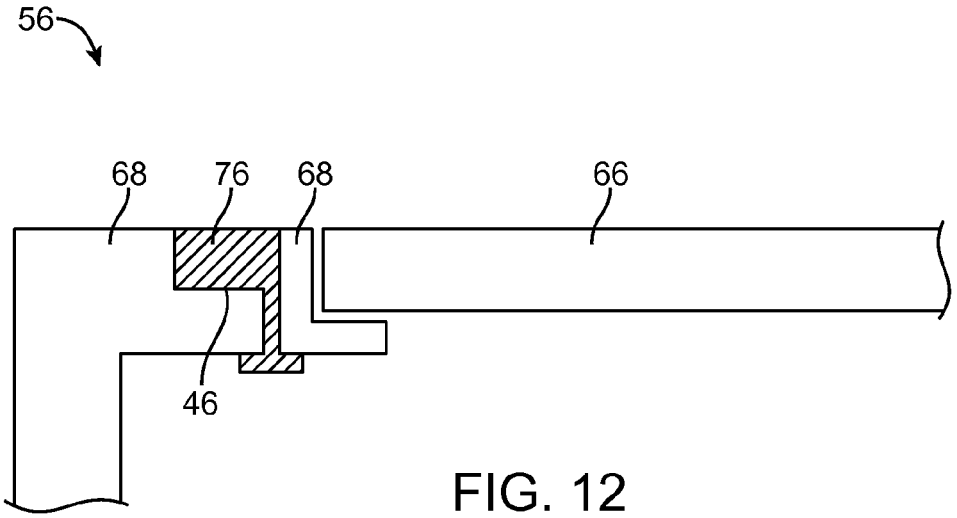
FIGS. 12, 13, 14, 15, and 16 are cross-sectional side views of illustrative configurations that may be used for mounting a component trim structure that serves as an antenna structure in an electronic device in accordance with an embodiment of the present invention.

FIG. 12 is a cross-sectional side view of structure 56 in a configuration in which antenna resonating element 46 has been embedded within structure 68. Structure 68 may be, for example, a plastic structure and antenna resonating element 46 may be a metal structure that is embedded within structure 68 by injection molding (i.e., insert molding). In the configuration of FIG. 12, portion 76 of antenna resonating element 46 has been exposed to the exterior of device 10, so that antenna resonating element 46 may serve as a cosmetic trim.

Figure 13:
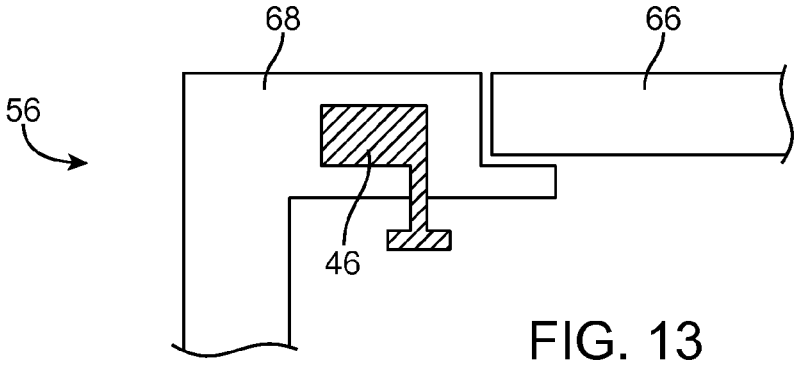

In the illustrative configuration of FIG. 13, antenna resonating element 46 has been embedded within structure 68 (e.g., by injection molding) so that antenna resonating element 46 is not visually exposed to the exterior of device 10.

Figure 14:
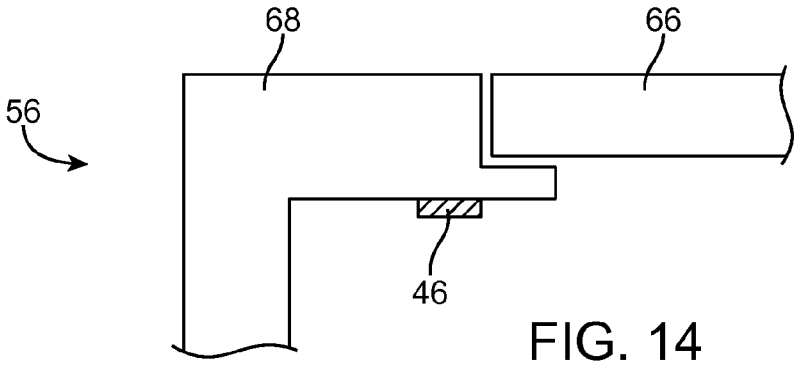

FIG. 14 is a cross-sectional side view of structure 56 in an illustrative configuration in which antenna resonating element 46 has been mounted on an interior surface of structure 68 in structure 58.

Figure 15:
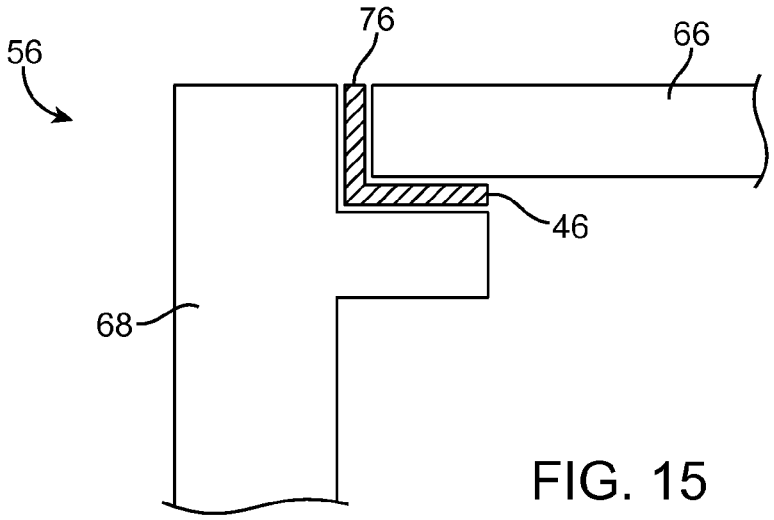

FIG. 15 is a cross-sectional side view of structure 56 in a configuration in which antenna resonating element 46 has an L-shaped cross-section. Portion 76 of antenna resonating element may be visible from the exterior of structure 56 so that antenna resonating element 46 of FIG. 15 may serve as cosmetic trim.

Figure 16:
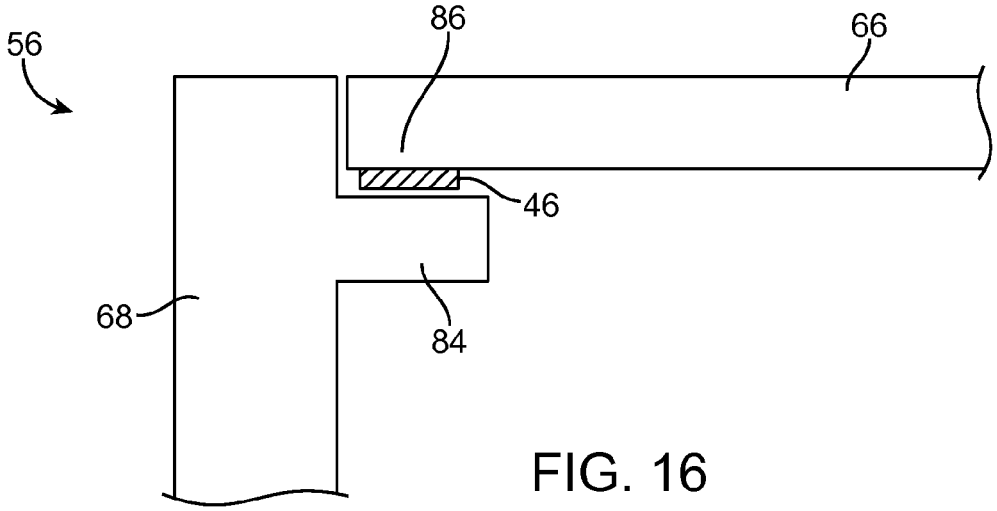

In the configuration of FIG. 16, antenna resonating element 46 has been mounted between ledge portion 84 of structure 68 and portion 86 of window 66. If desired, window 66 may be provided with a peripheral interior layer of opaque masking material such as black ink to help hide antenna resonating element 46 from view. As shown in the FIG. 16 example, the opaque masking material may be omitted so that a user may view antenna resonating element 46 through window 66 (e.g., an optically transparent window structure), allowing antenna resonating element 46 to serve as a cosmetic trim structure.

Figure 17:
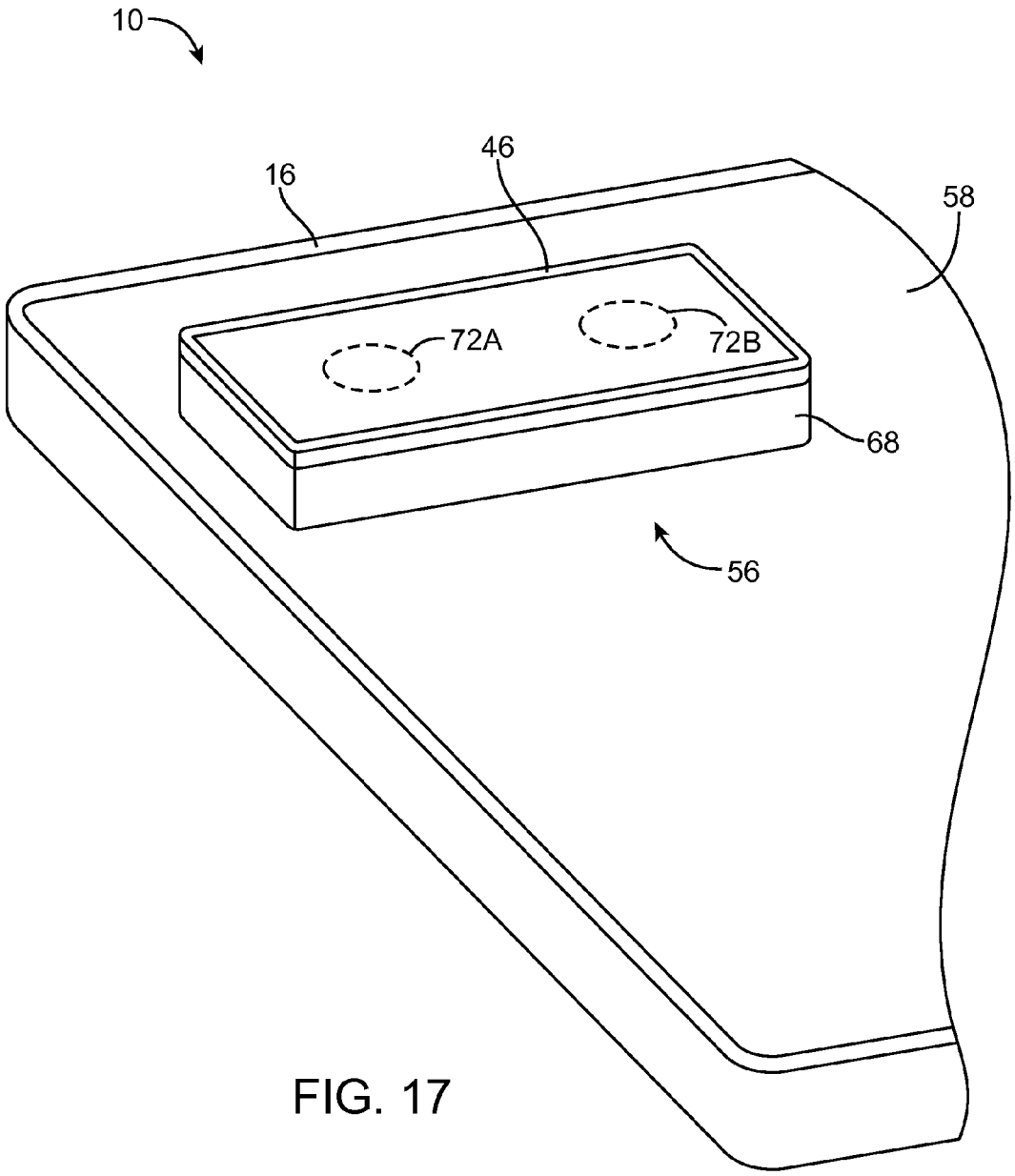
FIG. 17 is a perspective view of an illustrative structure that may be used as a cosmetic trim for one or more electronic device components and that may serve as an antenna structure in accordance with an embodiment of the present invention.

FIG. 17 is a perspective view of a portion of device 10 showing how antenna resonating element 46 may serve as a cosmetic trim for structure 56 in a configuration in which window 66 and structure 56 are associated with multiple components such as component 72A and component 72B. Components 72A and 72B may be optical components, acoustic components, or other electrical components. Light and/or sound associated with components 72A and 72B may pass through window 66. With one illustrative configuration, component 72A may be a camera and component 72B may be a light-emitting-diode-based flash or other light source that produces illumination for the camera, while window 66 may be an optically transparent structure. In another illustrative configuration, component 72A may be a light source and component 72B may be a light sensor (e.g., an infrared light source and sensor in a light-based proximity sensor). Components 72A and 72B may also be acoustic components such as speakers, microphones, buzzers, tone generators, etc. (e.g., in configurations in which window structure 66 is acoustically transparent). Sidewalls for structure 56 may be formed from portions 70 of structure 58 and/or additional structures that protrude from structure 58 such as structures 68 of FIG. 10.

Figure 18:
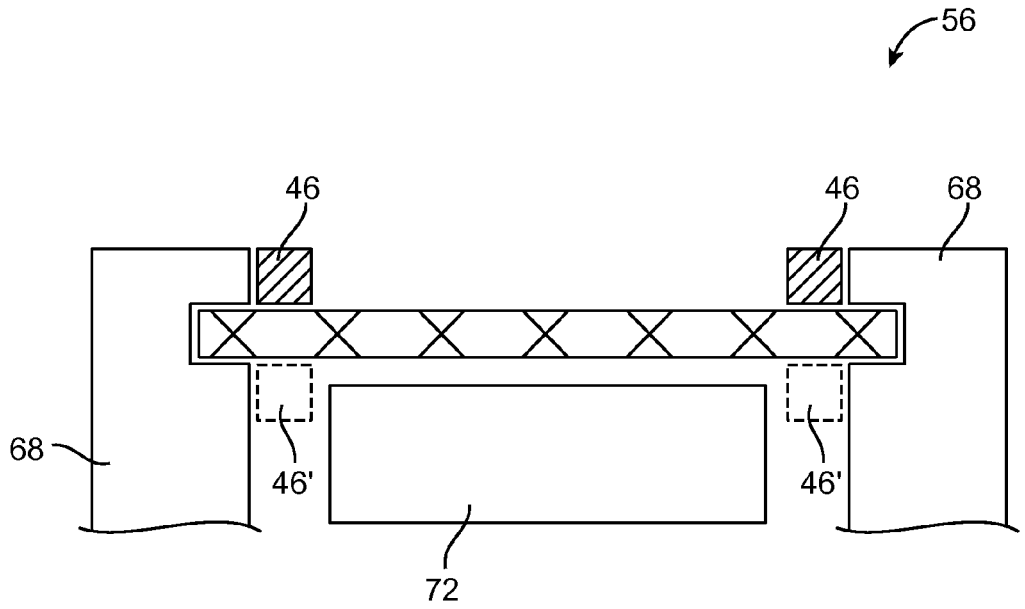
FIG. 18 is a cross-sectional side view of an illustrative audio component in an electronic device that may have a conductive trim structure that serves as an electronic device antenna structure in accordance with an embodiment of the present invention.

FIG. 18 is a cross-sectional side view of structure 56 in a configuration in which window 66 has been formed from an acoustically transparent material such as a mesh (e.g., a plastic mesh formed from interwoven plastic fibers) or a plastic member or other dielectric structure with an array of circular or rectangular openings (as an example). Antenna resonating element 46 may be formed on the exterior of window 66 (e.g., so that resonating element 46 surrounds the periphery of window 66 and forms a cosmetic trim for window 66, structure 56, and component 72) or may be formed on the interior of window 66 (e.g., where shown by antenna resonating element 46' of FIG. 18).

Structures 68 of FIGS. 10, 12, 13, 14, 15, 16, 17, and 18 may, if desired, be formed from portions 70 of structure 58 or one or more additional structures (e.g., portions of window structures such as structures 66, other portions of housing 12, etc.). Although structure 56 is shown as protruding above the surface of structure 58 (e.g., by height H), this is merely illustrative. Antenna resonating element 46 (e.g., a cosmetic trim structure) and window 66 may, if desired, lie flush with the exposed exterior surface of structure 58 in housing 12 of device 10.

The foregoing is merely illustrative of the principles of this invention and various modifications can be made by those skilled in the art without departing from the scope and spirit of the invention.

What is claimed is:

1. An electronic device, comprising:

a housing;

an optically transparent window mounted to the housing, wherein the optically transparent window has a periphery;

a dielectric structure having first and second surfaces; and a conductive antenna that runs along at least some of the periphery of the optically transparent window, wherein the conductive antenna comprises a conductive structure having a first portion formed on the first surface of the dielectric structure and having a second portion formed on the second surface of the dielectric structure.

2. The electronic device defined in claim 1, wherein the conductive antenna comprises a loop antenna that runs along substantially all of the periphery of the optically transparent window.

3. The electronic device defined in claim 1, further comprising:

a plurality of light-emitting elements mounted within the housing that are configured to emit light through the optically transparent window.

4. The electronic device defined in claim 3, wherein the housing comprises a conductive housing.

5. The electronic device defined in claim 4, wherein the conductive antenna is configured to transmit and receive wireless signals through the optically transparent window.

6. The electronic device defined in claim 4, wherein the optically transparent window protrudes from the conductive housing.

7. The electronic device defined in claim 6, wherein the electronic device comprises a cellular telephone.

8. An electronic device, comprising:

a housing having conductive side wall structures, wherein the conductive sidewall structures have an upper surface;

a plurality of optical components mounted in the housing;

an optically transparent window in the housing that overlaps the plurality of optical components, wherein the optical components emit light through the optically transparent window and the optically transparent window has a periphery and an internal surface;

a dielectric structure mounted to the upper surface of the conductive sidewall structures and that runs along the periphery of the optically transparent window; and an antenna mounted in the housing, wherein the antenna comprises a metal antenna resonating element that runs along at least some of the periphery of the optically transparent window, and wherein a portion of the metal antenna resonating element is formed between the upper surface of the conductive sidewall structures and the internal surface of the optically transparent window.

9. The electronic device defined in claim 8, wherein the plurality of optical components is configured to process images.

10. The electronic device defined in claim 8, wherein the conductive antenna traces comprise a resonating element for a loop antenna.

11. The electronic device defined in claim 1, wherein the first surface of the dielectric structure is substantially perpendicular to the second surface of the dielectric structure.

12. The electronic device defined in claim 11, wherein the conductive structure comprises an antenna resonating element of the conductive antenna.

13. The electronic device defined in claim 8, wherein the antenna comprises an inverted-F antenna having an antenna ground, the metal antenna resonating element comprises an inverted-F antenna resonating element arm for the inverted-F antenna, the inverted-F antenna comprises an antenna feed having a first antenna feed terminal coupled to the inverted-F antenna resonating element arm and a second antenna feed terminal coupled to the antenna ground, and the inverted-F antenna comprises a short circuit branch coupled between the inverted-F antenna resonating element arm and the antenna ground.

14. The electronic device defined in claim 1, wherein the conductive antenna comprises an inverted-F antenna having an antenna ground plane, the conductive structure comprises an inverted-F antenna resonating element arm for the inverted-F antenna, the inverted-F antenna comprises an antenna feed having a first antenna feed terminal coupled to the inverted-F antenna resonating element arm and a second antenna feed terminal coupled to the antenna ground, and the inverted-F antenna comprises a short circuit branch coupled between the inverted-F antenna resonating element arm and the antenna ground.

* * * * *